US009810456B2

(12) United States Patent
Sakamoto et al.

(10) Patent No.: US 9,810,456 B2
(45) Date of Patent: Nov. 7, 2017

(54) HEAT PUMP APPARATUS

(71) Applicant: Panasonic Corporation, Kadoma-shi, Osaka (JP)

(72) Inventors: Naoki Sakamoto, Gunma (JP); Yu Haraki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 531 days.

(21) Appl. No.: 14/385,342

(22) PCT Filed: Jan. 23, 2014

(86) PCT No.: PCT/JP2014/000329
§ 371 (c)(1),
(2) Date: Sep. 15, 2014

(87) PCT Pub. No.: WO2014/115555
PCT Pub. Date: Jul. 31, 2014

(65) Prior Publication Data

US 2015/0059383 A1 Mar. 5, 2015

(30) Foreign Application Priority Data

Jan. 24, 2013 (JP) ..... 2013-011323

(51) Int. Cl.
*F25B 30/02* (2006.01)
*F25B 43/04* (2006.01)
(Continued)

(52) U.S. Cl.
CPC ..... *F25B 30/02* (2013.01); *F25B 1/00* (2013.01); *F25B 41/06* (2013.01); *F25B 41/067* (2013.01); *F25B 43/04* (2013.01)

(58) Field of Classification Search
CPC ..... F25B 41/02; F25B 15/14; F25B 1/00
See application file for complete search history.

(56) References Cited

U.S. PATENT DOCUMENTS 4,593,534 A 6/1986 Bloomfiled
5,024,060 A 6/1991 Trusch
(Continued)

FOREIGN PATENT DOCUMENTS

JP 4-227440 8/1992
JP 9-196504 7/1997
(Continued)

OTHER PUBLICATIONS

Search Report issued in corresponding Chinese Patent Application No. 201480000867.5, dated Apr. 25, 2016, 2 pages.

*Primary Examiner* — Cassey D Bauer
(74) *Attorney, Agent, or Firm* — Hamre, Schumann, Mueller & Larson, P.C.

(57) ABSTRACT

A heat pump apparatus (100) includes an evaporator (10), an electrochemical compressor (11), a condenser (16), a refrigerant delivery path (18), and a non-condensable gas return path (28). The non-condensable gas return path (28) is provided separately from the refrigerant delivery path (18), and is configured to communicate a discharge-side high-pressure space of the electrochemical compressor (11) with a suction-side low-pressure space of the electrochemical compressor (11) so as to return a non-condensable gas from the high-pressure space to the low-pressure space. The non-condensable gas is, for example, hydrogen gas.

16 Claims, 6 Drawing Sheets

(51) Int. Cl.
*F25B 1/00* (2006.01)
*F25B 41/06* (2006.01)

(56) References Cited

U.S. PATENT DOCUMENTS

| | | | | |
|---|---|---|---|---|
| 5,687,576 | A | 11/1997 | Moriguchi et al. | |
| 6,553,771 | B2 * | 4/2003 | Tsenter | F04B 35/00 62/46.2 |
| 2010/0132386 | A1 | 6/2010 | Bahar | |
| 2011/0108246 | A1 | 5/2011 | Bahar | |

FOREIGN PATENT DOCUMENTS

| | | |
|---|---|---|
| JP | 2003-262423 | 9/2003 |
| JP | 2003-262424 | 9/2003 |
| WO | 2010127270 | 11/2010 |

* cited by examiner

HEAT PUMP APPARATUS

TECHNICAL FIELD

The present invention relates to heat pump apparatuses.

BACKGROUND ART

When a voltage is applied to an electrolyte membrane used in a fuel cell, hydrogen ($H_2$) is converted into protons ($H^+$), which move from one surface of the electrolyte membrane to the other surface thereof. When moving from one surface to the other surface through the electrolyte membrane, the protons are accompanied by a polar substance such as water, alcohol, or ammonia. The technique of compressing the gaseous polar substance using this phenomenon is called "electrochemical compression". Compressors to which this electrochemical compression is applied are called "electrochemical compressors". Patent Literatures 1 and 2 each describe a heat pump apparatus including an electrochemical compressor.

CITATION LIST

Patent Literature

Patent Literature 1: JP 2003-262424 A
Patent Literature 2: US 2010/0132386 A1

SUMMARY OF INVENTION

Technical Problem

When an electrochemical compressor is used in a heat pump apparatus, an electrochemically active gas such as hydrogen in addition to a refrigerant are essential to the apparatus. However, such an electrochemically active gas may hinder the improvement of the efficiency of the heat pump apparatus. Therefore, it is desirable to minimize the amount of the electrochemically active gas used in the apparatus.

The present disclosure provides a technique that enables a reduction of the amount of an electrochemically active gas used in a heat pump apparatus including an electrochemical compressor.

Solution to Problem

The present disclosure provides a heat pump apparatus including:

an evaporator that evaporates a refrigerant;

an electrochemical compressor that compresses the refrigerant evaporated in the evaporator by use of an electrochemically active, non-condensable gas;

a condenser that condenses the refrigerant compressed by the electrochemical compressor;

a refrigerant delivery path for delivering the refrigerant from the condenser to the evaporator; and a non-condensable gas return path provided separately from the refrigerant delivery path, the non-condensable gas return path being configured to communicate a discharge-side high-pressure space of the electrochemical compressor with a suction-side low-pressure space of the electrochemical compressor so as to return the non-condensable gas from the high-pressure space to the low-pressure space.

Advantageous Effects of Invention

According to the present disclosure, it is possible to reduce the amount of an electrochemically active gas used in a heat pump apparatus including an electrochemical compressor.

DESCRIPTION OF EMBODIMENTS

Figure 1:
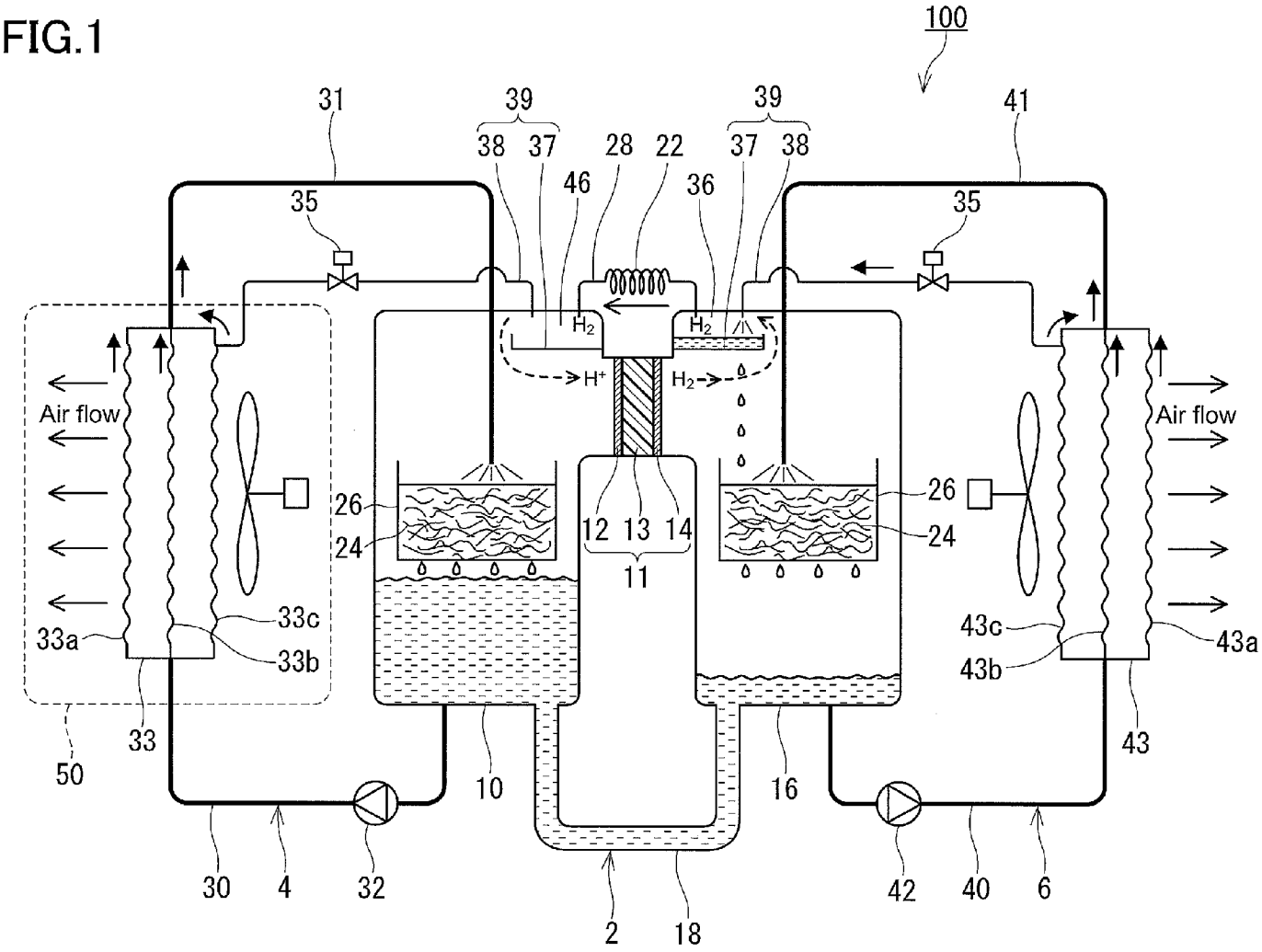
FIG. 1 is a configuration diagram of a heat pump apparatus according to an embodiment of the present invention in cooling operation.

As described above, a heat pump apparatus including an electrochemical compressor requires an electrochemically active gas. An electrochemically active gas is often non-condensable under the normal operation conditions of a heat pump apparatus and constitutes a limiting factor for heat transfer in the heat pump apparatus. For example, in the case where a fin-tube heat exchanger is used to exchange heat between a refrigerant and outdoor air, the thermal resistance of a non-condensable gas tends to be high on the heat transfer surface. Therefore, it is desirable to minimize the amount of such an electrochemically active gas used in a heat pump apparatus including an electrochemical compressor.

A first aspect of the present disclosure provides a heat pump apparatus including: an evaporator that evaporates a refrigerant; an electrochemical compressor that compresses the refrigerant evaporated in the evaporator by use of an electrochemically active, non-condensable gas; a condenser that condenses the refrigerant compressed by the electrochemical compressor; a refrigerant delivery path for delivering the refrigerant from the condenser to the evaporator; and a non-condensable gas return path provided separately from the refrigerant delivery path, the non-condensable gas return path being configured to communicate a discharge-side high-pressure space of the electrochemical compressor with a suction-side low-pressure space of the electrochemical compressor so as to return the non-condensable gas from the high-pressure space to the low-pressure space.

According to the first aspect, the non-condensable gas is returned from the discharge-side high-pressure space of the electrochemical compressor to the suction-side low-pressure space of the electrochemical compressor through the non-condensable gas return path. Therefore, the shortage of the non-condensable gas serving as a working fluid for compressing the refrigerant can be prevented. In other words, the amount of the non-condensable gas used (the amount of the non-condensable gas filled in the heat pump apparatus) can be reduced. In addition, since the amount of the non-condensable gas as a limiting factor for heat transfer can be reduced, the efficiency of the heat pump apparatus can be increased.

A second aspect of the present disclosure provides the heat pump apparatus according to the first aspect, further including a gate provided in the non-condensable gas return path, the gate being capable of maintaining a pressure difference between the high-pressure space and the low-pressure space and being capable of returning the non-condensable gas from the high-pressure space to the low-pressure space. It is possible to continue the operation of the heat pump apparatus while returning the non-condensable gas from the high-pressure space to the low-pressure space by maintaining the pressure difference between the high-pressure space and the low-pressure space.

A third aspect of the present disclosure provides the heat pump apparatus according to the second aspect, wherein the gate includes at least one selected from a capillary, a flow rate regulating valve, and an on-off valve. The advantage of a capillary is that no special control is required. In the case where an on-off valve is used as the gate, the non-condensable gas accumulated in the high-pressure space can be returned to the low-pressure space by opening the on-off valve at regular intervals. The advantage of a flow rate regulating valve is that the flow rate of the non-condensable gas in the non-condensable gas return path can be regulated by changing the opening degree of the valve.

A fourth aspect of the present disclosure provides the heat pump apparatus according to the second aspect, wherein the gate includes an upstream valve disposed on an upstream side in a flow direction of the non-condensable gas and a downstream valve disposed on a downstream side in the flow direction, and the heat pump apparatus further includes a valve controller that (i) controls the upstream valve and the downstream valve so that the downstream valve is closed and the upstream valve is opened, then (ii) controls the upstream valve and the downstream valve so that the upstream valve is closed while the downstream valve remains closed, and then (iii) controls the upstream valve and the downstream valve so that the downstream valve is opened while the upstream valve remains closed. According to the fourth aspect, it is possible to return the non-condensable gas efficiently from the high-pressure space to the low-pressure space while suppressing the backflow of the refrigerant vapor from the high-pressure space to the low-pressure space.

A fifth aspect of the present disclosure provides the heat pump apparatus according to the second aspect, wherein the non-condensable gas is hydrogen, and the gate includes a hydrogen permeable membrane having selective permeability to hydrogen. The use of the hydrogen permeable membrane makes it possible to reliably prevent the refrigerant from returning from the high-pressure space to the low-pressure space through the non-condensable gas return path.

A sixth aspect of the present disclosure provides the heat pump apparatus according to any one of the first to fifth aspects, wherein the non-condensable gas return path has one end connected to an upper part of the condenser. In the condenser, the refrigerant is cooled and condensed. The non-condensable gas tends to accumulate in the space of the upper part of the condenser due to the difference in the specific gravity. Therefore, when the non-condensable gas return path is connected to the upper part of the condenser, the non-condensable gas is easy to travel from the interior space (high-pressure space) of the condenser to the non-condensable gas return path.

A seventh aspect of the present disclosure provides the heat pump apparatus according to any one of the first to sixth aspects, further including a non-condensable gas trap as a structure that forms a part of the high-pressure space, the non-condensable gas trap being configured to locally increase a concentration of the non-condensable gas, wherein the non-condensable gas return path is connected to the non-condensable gas trap. According to the seventh aspect, it is possible to return the non-condensable gas from the high-pressure space to the low-pressure space efficiently and selectively.

An eighth aspect of the present disclosure provides the heat pump apparatus according to the seventh aspect, wherein the non-condensable gas trap is provided in an upper part of the condenser. According to the eighth aspect, the non-condensable gas can easily be collected in the non-condensable gas trap due to the difference in the specific gravity.

A ninth aspect of the present disclosure provides the heat pump apparatus according to the seventh or eighth aspect, wherein the non-condensable gas trap includes a partition that surrounds the part of the high-pressure space and a pressure reducing mechanism that reduces a pressure of the space surrounded by the partition. The non-condensable gas can be drawn into the space surrounded by the partition by reducing the pressure of the space.

A tenth aspect of the present disclosure provides the heat pump apparatus according to the ninth aspect, wherein the pressure reducing mechanism is a low-temperature refrigerant introduction path through which a low-temperature refrigerant obtained by cooling a portion of the refrigerant held in the condenser is introduced into the space surrounded by the partition. The pressure of the space surrounded by the partition can be reduced easily by introducing the low-temperature refrigerant into the space to lower the temperature of that space.

An eleventh aspect of the present disclosure provides the heat pump apparatus according to any one of the first to tenth aspects, wherein the refrigerant includes at least one natural refrigerant selected from the group consisting of water, alcohol, and ammonia. The use of such a natural refrigerant is desirable from the environmental perspectives such as protection of the ozone layer and prevention of global warming.

An twelfth aspect of the present disclosure provides the heat pump apparatus according to any one of the first to eleventh aspects, wherein the non-condensable gas is hydrogen. When the non-condensable gas is hydrogen, the difference in the specific gravity between the hydrogen gas and the refrigerant can be used to separate them from each other.

An thirteenth aspect of the present disclosure provides the heat pump apparatus according to any one of the first to twelfth aspects, wherein a positional relationship of the electrochemical compressor, the non-condensable gas return path, the condenser, and the evaporator is determined so that the electrochemical compressor and the non-condensable gas return path are located above a liquid level of the refrigerant held in the condenser and above a liquid level of the refrigerant held in the evaporator in a vertical direction. According to the thirteenth aspect, the electrochemical compressor can easily draw the non-condensable gas thereinto.

An fourteenth aspect of the present disclosure provides the heat pump apparatus according to any one of the first to thirteenth aspects, further including: a first circulation path which includes a first pump and a first heat exchanger and through which the refrigerant or another heating medium is circulated via the evaporator and the first heat exchanger by action of the first pump; a second circulation path which includes a second pump and a second heat exchanger and through which the refrigerant or another heating medium is circulated via the condenser and the second heat exchanger by action of the second pump; and a power supply controller that switches polarity of a voltage applied to the electrochemical compressor so as to switch between a first operation mode and a second operation mode, the first operation mode being an operation mode in which the first circulation path serves as a heat absorption circuit and the second circulation path serves as a heat dissipation circuit, and the second operation mode being an operation mode in which the first circulation path serves as a heat dissipation circuit and the second circulation path serves as a heat absorption circuit. According to the fourteenth aspect, it is possible to switch heating operation and cooling operation without using a circuit (four-way valve) for switching the flow direction of the refrigerant.

A fifteenth aspect of the present disclosure provides the heat pump apparatus according to any one of the first to fourteenth aspects, further including a startup assist mechanism that wets an electrolyte membrane in the electrochemical compressor with the refrigerant in liquid phase during startup of the heat pump apparatus. The electrochemical compressor can be started up easily by spraying the refrigerant liquid onto the electrolyte membrane in the electrochemical compressor to wet the electrolyte membrane appropriately.

A sixteenth aspect of the present disclosure provides a heat pump apparatus including: an evaporator that evaporates a refrigerant; an electrochemical compressor that compresses the refrigerant evaporated in the evaporator by use of an electrochemically active, non-condensable gas, the electrochemical compressor comprising an electrolyte membrane, a molecule-permeable first electrode disposed on a side of a first principal surface of the electrolyte membrane, and a molecule-permeable second electrode disposed on a side of a second principal surface of the electrolyte membrane; a condenser that condenses the refrigerant compressed by the electrochemical compressor; and a power supply controller that switches between a first operation mode in which a potential of the first electrode is higher than a potential of the second electrode and a second operation mode in which the potential of the second electrode is higher than the potential of the first electrode.

According to the sixteenth aspect, it is possible to switch heating operation and cooling operation without using a circuit (four-way valve) for switching the flow direction of the refrigerant.

A seventeenth aspect of the present disclosure provides the heat pump apparatus according to the sixteenth aspect, further including a refrigerant delivery path for delivering the refrigerant from the condenser to the evaporator; and a non-condensable gas return path provided separately from the refrigerant delivery path, the non-condensable gas return path being configured to communicate a discharge-side high-pressure space of the electrochemical compressor with a suction-side low-pressure space of the electrochemical compressor so as to return the non-condensable gas from the high-pressure space to the low-pressure space. According to the seventeenth aspect, it is possible to obtain the same effects as in the first aspect.

Hereinafter, embodiments of the present invention will be described with reference to the drawings. The present invention is not limited to the following embodiments.

As shown in FIG. 1, a heat pump apparatus 100 of the present embodiment includes a main circuit 2, a first circulation path 4, and a second circulation path 6. Both ends of the first circulation path 4 are connected to the main circuit 2. Both ends of the second circulation path 6 also are connected to the main circuit 2. The main circuit 2, the first circulation path 4, and the second circulation path 6 are filled with a refrigerant and a non-condensable gas as working fluids. The refrigerant is a condensable fluid. The non-condensable gas is an electrochemically active gas, and is used to compress the refrigerant in the main circuit 2.

In the present embodiment, hydrogen gas is used as the electrochemically active, non-condensable gas. Therefore, the hydrogen gas and the refrigerant can be separated from each other using the difference in their specific gravity. A polar substance is used as the refrigerant. More specifically, a natural refrigerant such as water, alcohol, or ammonia can be used as the refrigerant. The use of such a natural refrigerant is desirable from the environmental perspectives such as protection of the ozone layer and prevention of global warming. Examples of the alcohol include lower alcohols such as methanol and ethanol. Water and alcohol are the refrigerants whose saturated vapor pressures are negative pressures (i.e., pressures that are lower than an atmospheric pressure in terms of absolute pressure) at ordinary temperature (i.e., 20° C.±15° C. according to Japanese Industrial Standards (JIS) Z 8703). When a refrigerant whose saturated vapor pressure is a negative pressure at ordinary temperature is used, the pressure inside the heat pump apparatus 100 in operation is lower than the atmospheric pressure. In the case where ammonia is used as the refrigerant, the heat pump apparatus 100 can be operated, for example, under the conditions in which the pressures inside an evaporator 10 and a condenser 16 are higher than the atmospheric pressure. The refrigerants mentioned above may be used alone, or two or more of them may be used in combination. The refrigerant may contain an antifreeze agent to prevent freezing or for any other reason. As the antifreeze agent, an alcohol such as ethylene glycol or propylene glycol can be used. Such an antifreeze-containing refrigerant is, for example, a water-alcohol mixed refrigerant. Alcohols can also act as refrigerants.

The main circuit 2 is a circuit in which a refrigerant is circulated, and includes an evaporator 10, an electrochemical compressor 11, a condenser 16, a refrigerant delivery path 18, and a non-condensable gas return path 28. The refrigerant passes through the evaporator 10, the electrochemical compressor 11, the condenser 16, and the refrigerant delivery path 18 in this order. The main circuit 2 may have a vapor path (not shown) for supplying refrigerant vapor generated in the evaporator 10 to the condenser 16 while compressing the refrigerant vapor in the electrochemical compressor 11. In this case, the electrochemical compressor 11 is disposed in the vapor path.

The electrochemical compressor 11 compresses the refrigerant evaporated in the evaporator 10 by use of an electrochemically active, non-condensable gas. Specifically, the electrochemical compressor 11 includes an electrolyte membrane 13 (an electrolyte layer), a first electrode 12, and a second electrode 14. That is, the electrochemical compressor 11 has a structure of a membrane-electrode assembly (MEA) used in a polymer electrolyte fuel cell. The electrolyte membrane 13 is, for example, a perfluorosulfonic acid membrane such as "Nafion" (registered trademark of DuPont). The first electrode 12 is disposed on the side of the first principal surface of the electrolyte membrane 13. The second electrode 14 is disposed on the side of the second principal surface of the electrolyte membrane 13. The first electrode 12 and the second electrode 14 are each composed of, for example, an electrically conductive substrate such as carbon cloth and a noble metal catalyst supported on the electrically conductive substrate. The first electrode 12 and the second electrode 14 each have the properties of allowing refrigerant molecules and non-condensable gas molecules to pass therethrough.

In this description, the "electrochemically active gas" refers to a gas capable of moving, along with polar substances, through the electrolyte membrane 13 from one surface to the other surface thereof. The "non-condensable gas" refers to a gaseous substance in vapor phase under the normal operation conditions of the heat pump apparatus 100, for example, at a temperature of −25° C. or higher and a pressure of less than 2 MPa.

The evaporator 10 is formed of, for example, a heat insulating, pressure-resistant container. The upstream end and the downstream end of the first circulation path 4 are connected to the evaporator 10. Refrigerant liquid stored in the evaporator 10 comes into direct contact with the refrigerant liquid that is heated while circulating in the first circulation path 4. That is, a portion of the refrigerant liquid stored in the evaporator 10 is heated in the first circulation path 4 and used as a heat source for heating the saturated refrigerant liquid. The saturated refrigerant liquid is heated to generate the refrigerant vapor.

A small, open-top tank 26 is placed in the evaporator 10. The tank 26 is provided with a porous filler 24. The downstream end of the first circulation path 4 extends from the upper part of the evaporator 10 toward the tank 26 so as to spray the refrigerant liquid onto the packing material 24. When the refrigerant liquid is sprayed onto the filler 24 in the tank 26, the area of the vapor-liquid interface increases, thereby the generation of the refrigerant vapor is accelerated. A portion of the refrigerant liquid flows down through holes formed in the bottom of the tank 26 and stored in the evaporator 10. The filler 24 and the tank 26 are not essential components as long as the refrigerant vapor can be generated efficiently.

The first circulation path 4 is composed of a flow path 30, a flow path 31, a first pump 32, and a first heat exchanger 33. The bottom of the evaporator 10 and the inlet of the first heat exchanger 33 are connected by the flow path 30. The outlet of the first heat exchanger 33 and the upper part of the evaporator 10 are connected by the flow path 31. The first pump 32 is disposed in the flow path 30. The first heat exchanger 33 is formed of a known heat exchanger such as a fin-tube heat exchanger. The refrigerant is circulated between the evaporator 10 and the first heat exchanger 33 by the action of the first pump 32. In the case where the heat pump apparatus 100 is an air conditioner, the first heat exchanger 33 is placed indoors. As shown in FIG. 1, when an indoor space is cooled, the indoor air is cooled by the refrigerant liquid in the first heat exchanger 33.

The first circulation path 4 may be configured such that the refrigerant liquid stored in the evaporator 10 is not mixed with another heating medium circulating in the first circulation path 4. For example, in the case where the evaporator 10 has a heat exchange structure such as a shell-tube heat exchanger, the refrigerant liquid stored in the evaporator 10 can be heated by the other heating medium circulating in the first circulation path 4 and thus evaporated. The other heating medium for heating the refrigerant liquid stored in the evaporator 10 flows in the first heat exchanger 33. The other heating medium is not particularly limited. As the other heating medium, water, brine, or the like can be used.

The condenser 16 is formed of, for example, a heat insulating, pressure-resistant container. The upstream end and the downstream end of the second circulation path 6 are connected to the condenser 16. The refrigerant vapor compressed by the electrochemical compressor 11 comes into direct contact with the refrigerant liquid that is cooled while circulating in the second circulation path 6. That is, a portion of the refrigerant liquid stored in the condenser 16 is cooled in the second circulation path 6 and used as a cold source for cooling the superheated refrigerant vapor. The superheated refrigerant vapor is cooled to generate the high-temperature refrigerant liquid.

A small tank 26 provided with a porous filler 24 is placed in the condenser 16, as in the evaporator 10. When the refrigerant liquid is sprayed onto the filler 24 in the tank 26, the area of the vapor-liquid interface increases, thereby the condensation of the refrigerant is accelerated. A portion of the refrigerant liquid flows down through holes formed in the bottom of the tank 26 and stored in the condenser 16. The filler 24 and the tank 26 are not essential components as long as the refrigerant vapor can be condensed efficiently.

The second circulation path 6 is composed of a flow path 40, a flow path 41, a second pump 42, and a second heat exchanger 43. The bottom of the condenser 16 and the inlet of the second heat exchanger 43 are connected by the flow path 40. The outlet of the second heat exchanger 43 and the upper part of the condenser 16 are connected by the flow path 41. The second pump 42 is disposed in the flow path 40. The second heat exchanger 43 is formed of a known heat exchanger such as a fin-tube heat exchanger. The refrigerant is circulated between the condenser 16 and the second heat exchanger 43 by the action of the second pump 42. In the case where the heat pump apparatus 100 is an air conditioner, the second heat exchanger 43 is placed outdoors. As shown in FIG. 1, when an indoor space is cooled, the refrigerant liquid is cooled by the outdoor air in the second heat exchanger 43.

The second circulation path 6 may be configured such that the refrigerant liquid stored in the condenser 16 is not mixed with another heating medium circulating in the second circulation path 6, as in the first circulation path 4. For example, in the case where the condenser 16 has a heat exchange structure such as a shell-tube heat exchanger, the refrigerant vapor supplied to the condenser 16 can be cooled by the other heating medium circulating in the second circulation path 6 and thus condensed. The other heating medium for cooling the refrigerant vapor supplied to the condenser 16 flows in the second heat exchanger 43.

Figure 2:
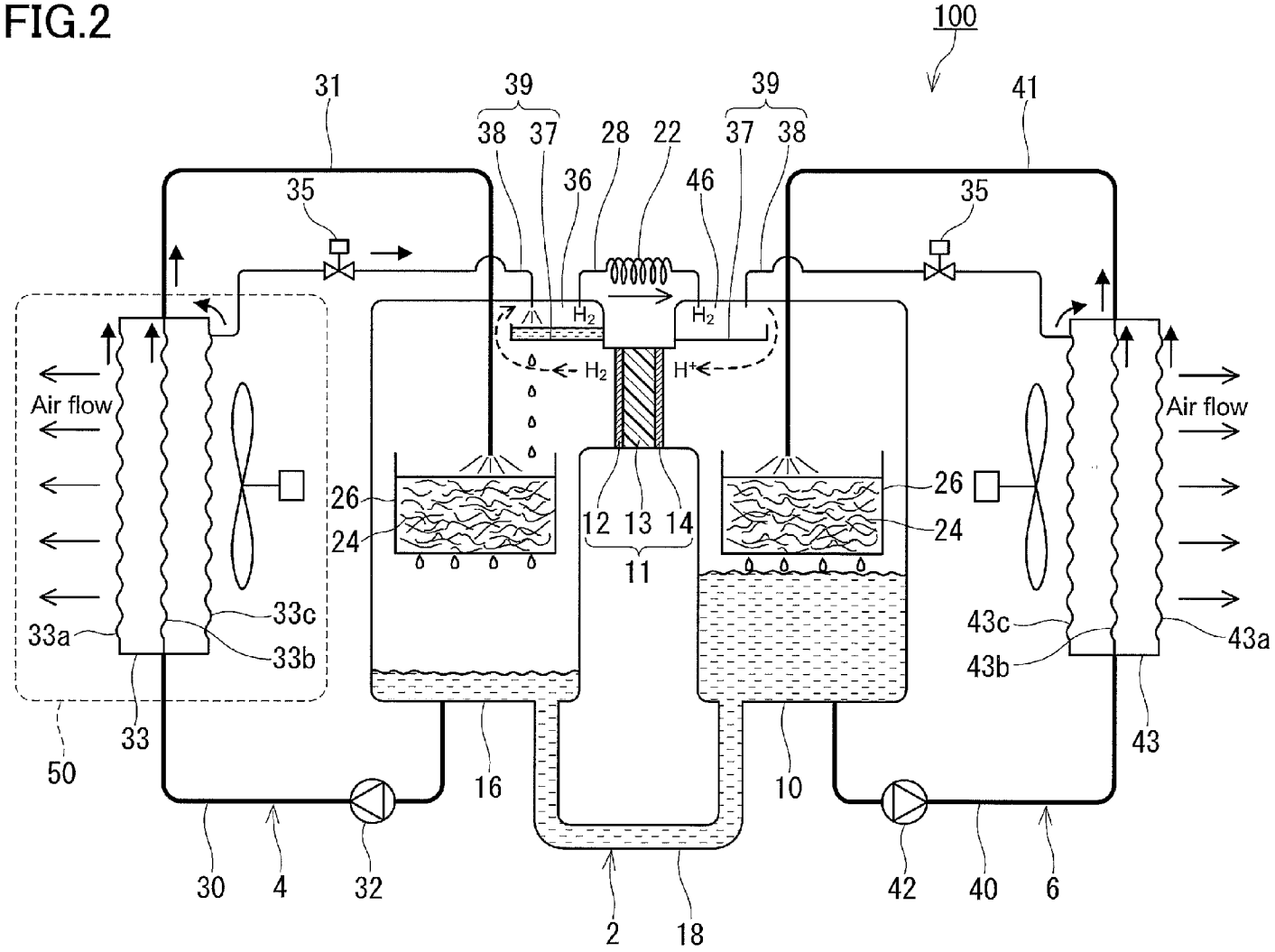
FIG. 2 is a configuration diagram of the heat pump apparatus shown in FIG. 1 in heating operation.

When the first circulation path 4 is connected to the evaporator 10 and the second circulation path 6 is connected to the condenser 16, respectively, as shown in FIG. 1, the first circulation path 4 serves as a heat absorption circuit for heating the refrigerant and the second circulation path 6 serves as a heat dissipation circuit for cooling the refrigerant, respectively. On the other hand, when the polarity of the voltage applied to the electrochemical compressor 11 is switched as shown in FIG. 2, the evaporator 10 and the condenser 16 are switched to each other. When the first circulation path 4 is connected to the condenser 16 and the second circulation path 6 is connected to the evaporator 10, respectively, the first circulation path 4 serves as a heat dissipation circuit for cooling the refrigerant and the second circulation path 6 serves as a heat absorption circuit for heating the refrigerant, respectively. When the heat pump apparatus 100 is an air conditioner, the first heat exchanger 33 is placed in an indoor unit 50, and the second heat exchanger 43 is placed in an outdoor unit, FIG. 1 shows the heat pump apparatus 100 in the cooling operation, while FIG. 2 shows the heat pump apparatus 100 in the heating operation.

When the heat pump apparatus 100 is a chiller, a hot-water heating system, or a water-cooled condenser, the first heat exchanger 33 and/or the second heat exchanger 43 can be a liquid-liquid heat exchanger that allows a heating medium such as brine or water and a refrigerant to exchange heat.

In the present embodiment, the first circulation path 4 is used to heat the refrigerant liquid stored in the evaporator 10, and the second circulation path 6 is used to cool the refrigerant liquid stored in the condenser 16. In such a system, in which the refrigerant liquid is forced to circulate in the first circulation path 4 and the second circulation path 6, the negative impact of the non-condensable gas on the heat exchangers 33 and 34 can be minimized. In the case where a refrigerant (for example, ammonia) having a relatively high saturated vapor pressure is used, the partial pressure of the non-condensable gas has less impact. In this case, commonly used heat exchangers in which a refrigerant is evaporated in a heat transfer tube or condensed therein may be used as the heat exchangers 33 and 43 instead of heat exchangers in which refrigerant liquid is circulated.

As shown in FIG. 1, the refrigerant delivery path 18 is a flow path for delivering the refrigerant (more specifically, the refrigerant liquid) from the condenser 16 to the evaporator 10. The bottom of the evaporator 10 and the bottom of the condenser 16 are connected by the refrigerant delivery path 18. The refrigerant delivery path 18 may be provided with a capillary, a variable opening expansion valve, or the like.

The non-condensable gas return path 28 is a path provided separately from the refrigerant delivery path 18, and is configured to communicate a discharge-side high-pressure space of the electrochemical compressor 11 with a suction-side low-pressure space of the electrochemical compressor 11 so as to return the non-condensable gas from the high-pressure space to the low-pressure space. Since the non-condensable gas is returned from the high-pressure space to the low-pressure space through the non-condensable gas return path 28, the shortage of the non-condensable gas serving as a working fluid for compressing the refrigerant can be prevented. In other words, the amount of the non-condensable gas used (the amount of the non-condensable gas filled in the heat pump apparatus 100) can be reduced. In addition, since the flow of the non-condensable gas as a limiting factor for heat transfer into the heat exchangers 33 and 43 in which the refrigerant liquid is circulating can be reduced, the efficiency of the heat pump apparatus 100 can be increased. In the present embodiment, the non-condensable gas return path 28 is connected directly to the condenser 16 and the evaporator 10 so as to communicate the interior space (high-pressure space) of the condenser 16 with the interior space (low-pressure space) of the evaporator 10.

The non-condensable gas return path 28 is provided with a gate 22 capable of maintaining the pressure difference between the high-pressure space and the low-pressure space and capable of returning the non-condensable gas from the high-pressure space to the low-pressure space. It is possible to continue the operation of the heat pump apparatus 100 while returning the non-condensable gas from the high-pressure space to the low-pressure space by maintaining the pressure difference between the high-pressure space and the low-pressure space.

Specifically, a capillary, a flow rate regulating valve, or an on-off valve can be used as the gate 22. The advantage of a capillary is that no special control is required. In the case where an on-off valve is used as the gate 22, the non-condensable gas accumulated in the high-pressure space can be returned to the low-pressure space by opening the on-off valve at regular intervals. As described later, in the case where a non-condensable gas trap 39 is provided, the on-off valve may be opened in a timely manner as soon as a sufficient amount of the non-condensable gas is accumulated in the non-condensable gas trap 39. Thereby, it is possible to return the non-condensable gas efficiently from the high-pressure space to the low-pressure space while suppressing a decrease in the efficiency of the heat pump apparatus 100. Since the refrigerant and the non-condensable gas cannot pass through the non-condensable gas return path 28 when the on-off valve is in a closed position, the heat pump apparatus 100 can be operated efficiently. The advantage of the flow rate regulating valve is that the flow rate of the non-condensable gas in the non-condensable gas return path can be regulated by changing the opening degree of the valve. The flow rate regulating valve and the on-off valve can be operated electrically, pneumatically, or hydraulically. The flow rate regulating valve may be used for the same purpose as the on-off valve in some cases. Two or more different types of components arbitrarily selected from a capillary, a flow rate regulating valve, and an on-off valve may be used in combination as the gate 22. Alternatively, two or more components of the same type may be used as the gate 22.

Figure 3:
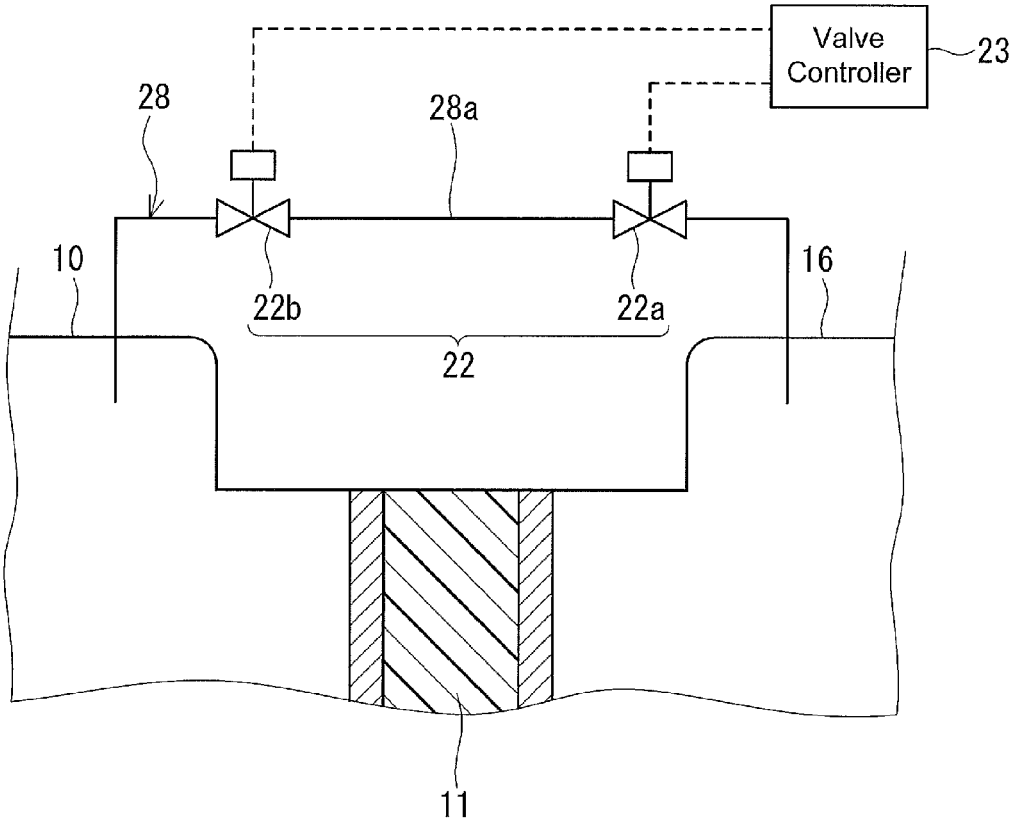
FIG. 3 is a configuration diagram of an example of a gate provided in a non-condensable gas return path.

For example, as shown in FIG. 3, the gate 22 can be composed of an upstream valve 22*a* and a downstream valve 22*b*. The upstream valve 22*a* is a valve disposed on the upstream side in the flow direction of the non-condensable gas in the non-condensable gas return path 28. The downstream valve 22*b* is a valve disposed on the downstream side in the flow direction of the non-condensable gas in the non-condensable gas return path 28. The upstream valve 22*a* and the downstream valve 22*b* are disposed apart from each other in the non-condensable gas return path 28 so that an appropriate amount of the non-condensable gas can be temporarily held in an intermediate portion 28*a* of the non-condensable gas return path 28 between the upstream valve 22*a* and the downstream valve 22*b*. The upstream valve 22*a* and the downstream valve 22*b* are controlled by a valve controller 23. The valve controller 23 controls the upstream valve 22*a* and the downstream valve 22*b* in the following manner. First, the valve controller 23 controls the upstream valve 22*a* and the downstream valve 22*b* so that the downstream valve 22*b* is closed and the upstream valve 22*a* is opened. As a result, the non-condensable gas is accumulated in the intermediate portion 28*a*. Next, the valve controller 23 controls the upstream valve 22*a* and the downstream valve 22*b* so that the upstream valve 22*a* is closed while the downstream valve 22*b* remains closed. As a result, the non-condensable gas is trapped in the intermediate portion 28*a*. The valve controller 23 further controls the upstream valve 22*a* and the downstream valve 22*b* so that the downstream valve 22*b* is opened while the upstream valve 22*a* remains closed. As a result, the non-condensable gas is released into the low-pressure space. By performing these controls in this order, it is possible to return the non-condensable gas efficiently from the high-pressure space to the low-pressure space while suppressing the back-flow of the refrigerant vapor from the high-pressure space to the low-pressure space. The method described with reference to FIG. 3 is particularly effective when there is a sufficient difference in the specific gravity between the non-condensable gas and the refrigerant vapor.

When hydrogen is used as the non-condensable gas, a hydrogen permeable membrane having selective permeability to hydrogen can be used as the gate 22. Known hydrogen permeable membranes are, for example, zeolite membranes and palladium membranes (including palladium alloy membranes). Palladium membranes are selectively permeable to hydrogen when sufficiently heated by a heater. The use of any of these hydrogen permeable membranes makes it possible to reliably prevent the refrigerant vapor from returning from the high-pressure space to the low-pressure space through the non-condensable gas return path 28.

As shown in FIG. 1, the non-condensable gas return path 28 has one end connected to the upper part of the condenser 16. In the condenser 16, the refrigerant is cooled and condensed. The non-condensable gas tends to accumulate in the space of the upper part of the condenser 16 due to the difference in the specific gravity. Therefore, when the non-condensable gas return path 28 is connected to the upper part of the condenser 16, the non-condensable gas is easy to travel from the interior space (high-pressure space) of the condenser 16 to the non-condensable gas return path 28. As described later, in the heat pump apparatus 100 of the present embodiment, the polarity of the voltage applied to the electrochemical compressor 11 is switched and thereby the evaporator 10 and the condenser 16 are switched to each other (see FIG. 4 and FIG. 5). Therefore, it is desirable that the non-condensable gas return path 28 have one end connected to the upper part of the condenser 16 and the other end connected to the upper part of the evaporator 10.

The heat pump apparatus 100 further includes, as a structure that forms a part of the discharge-side high-pressure space of the electrochemical compressor 11, a non-condensable gas trap 39 configured to locally increase the concentration (partial pressure) of the non-condensable gas. The non-condensable gas return path 28 is connected to the non-condensable gas trap 39. With this configuration, it is possible to return the non-condensable gas from the high-pressure space to the low-pressure space efficiently and selectively.

In the case where the specific gravity of the non-condensable gas is smaller than that of the refrigerant vapor, the non-condensable gas trap 39 is desirably provided in the upper part of the condenser 16. With this configuration, the non-condensable gas can easily be collected in the non-condensable gas trap 39 due to the difference in the specific gravity. Specifically, the non-condensable gas trap 39 has a partition 37 and a pressure reducing mechanism 38. The partition 37 is a portion that surrounds the part of the high-pressure space. In the present embodiment, the partition 37 is disposed in the condenser 16 and surrounds a part of the interior space of the condenser 16. The pressure reducing mechanism 38 has the function of reducing the pressure of the space 36 surrounded by the partition 37. The non-condensable gas can be drawn into the space 36 surrounded by the partition 37 by reducing the pressure of the space 36. The values of the specific gravity of the non-condensable gas and that of the refrigerant vapor in the condenser 16 of the heat pump apparatus 100 in operation are used for comparison. Specifically, when the temperature in the condenser 16 is a specific temperature and the non-condensable gas has an arbitrary partial pressure in the condenser 16, the "specific gravity of the non-condensable gas" can be calculated from the density of the non-condensable gas at that temperature and that partial pressure. Likewise, when the temperature in the condenser 16 is a specific temperature, the "specific gravity of the refrigerant vapor" can be calculated from the density of the refrigerant vapor at the saturated vapor pressure of the refrigerant at that temperature. The "specific temperature" refers to any arbitrary temperature that the refrigerant can have in the condenser 16 of the heat pump apparatus 100 in normal operation. The term "specific gravity" is used, for example, as a measure of the ratio of the density of the non-condensable gas or the refrigerant vapor relative to the density of air (the value at 0° C. and 1 atmospheric pressure).

The pressure reducing mechanism 38 is, for example, a low-temperature refrigerant introduction path 38. The low-temperature refrigerant introduction path 38 serves to introduce, into the space 36 surrounded by the partition 37, a low-temperature refrigerant obtained by extracting a portion of the refrigerant held in the condenser 16 and cooling the portion outside the condenser 16. The pressure of the space 36 surrounded by the partition 37 can be reduced easily by introducing the low-temperature refrigerant into the space 36 to lower the temperature of that space 36. It is possible to avoid the use of a special cooling structure and another refrigerant by using the refrigerant in the heat pump apparatus 100 as a medium for lowering the temperature of the space 36. In the present embodiment, the partition 37 has a recessed shape so as to receive the low-temperature refrigerant from the low-temperature refrigerant introduction path 38 and hold it temporarily. The low-temperature refrigerant introduced into the space 36 through the low-temperature refrigerant introduction path 38 is temporarily held in the partition 37 and flows down through holes formed in the bottom of the partition 37. The outlet end of the low-temperature refrigerant introduction path 38 may have a structure capable of spraying the low-temperature refrigerant into the space 36 so as to lower the temperature of the space 36 effectively.

The inlet end of the low-temperature refrigerant introduction path 38 is connected to the second heat exchanger 43. When the second heat exchanger 43 is a fin-tube heat exchanger and has a plurality of branch paths 43*a* to 43*c*, the inlet end of the low-temperature refrigerant introduction path 38 is connected to the downstream portion of the branch path 43*c* located on the most windward side among these branch paths 43*a* to 43*c*. The temperature of the refrigerant liquid cooled in the windward branch path 43*c* is relatively lower than that of the refrigerant liquid cooled in the branch paths 43*b* and 43*a* located on the leeward side. Therefore, it is possible to lower the temperature of the space 36 more effectively by introducing the refrigerant liquid cooled in the branch path 43*c* into the space 36 through the low-temperature refrigerant introduction path 38. As a result, the non-condensable gas can be efficiently collected in the space 36. The low-temperature refrigerant introduction path 38 may branch from the flow path 41. The low-temperature refrigerant introduction path 38 may be provided with an on-off valve 35. Thereby, it is possible to prohibit the introduction of the refrigerant into the space 36 through the low-temperature refrigerant introduction path 38. However, the on-off valve 35 may be omitted so that the refrigerant be always introduced into the space 36 through the low-temperature refrigerant introduction path 38. Instead of the on-off valve 35, a fixed throttle such as a capillary may be provided.

In the present embodiment, the non-condensable gas trap 39 is provided in the condenser 16. However, the non-condensable gas trap 39 does not necessarily have to be provided in the condenser 16. For example, when a vapor path that connects the electrochemical compressor 11 and the condenser 16 is provided, the non-condensable gas trap 39 may be provided on that vapor path.

As described later, in the heat pump apparatus 100 of the present embodiment, the polarity of the voltage applied to the electrochemical compressor 11 is switched and thereby the evaporator 10 and the condenser 16 are switched to each other (see FIG. 4 and FIG. 5). Therefore, another non-condensable gas trap 39 having the same structure as the non-condensable gas trap 39 provided in the upper part of the condenser 16 is also provided in the upper part of the evaporator 10. A space 46 surrounded by a partition 37 of the non-condensable gas trap 39 is a part of the low-pressure space. The non-condensable gas is returned to this space 46 through the non-condensable gas return path 28. When returned to the low-pressure space, the non-condensable gas is used again in the electrochemical compressor 11 to compress the refrigerant. It is desirable that the other end (outlet end) of the non-condensable gas return path 28 be located near the suction port of the electrochemical compressor 11 so that the non-condensable gas can easily reach the electrochemical compressor 11 after being returned to the low-pressure space.

The non-condensable gas trap 39 provided in the upper part of the evaporator 10 also has a low-temperature refrigerant introduction path 38. The inlet end of the low-temperature refrigerant introduction path 38 is connected, for example, to the first heat exchanger 33. When the first heat exchanger 33 is a fin-tube heat exchanger and has a plurality of branch paths 33*a* to 33*c*, the inlet end of the low-temperature refrigerant introduction path 38 is connected to the downstream portion of the branch path 33*c* located on the most windward side among these branch paths 33*a* to 33*c*. The low-temperature refrigerant introduction path 38 may branch from the flow path 31. The low-temperature refrigerant introduction path 38 may be provided with an on-off valve 35. Instead of the on-off valve 35, a fixed throttle such as a capillary may be provided.

In the present embodiment, the positional relationship of the electrochemical compressor 11, the non-condensable gas return path 28, the condenser 16, and the evaporator 10 are determined so that the electrochemical compressor 11 and the non-condensable gas return path 28 are located above the liquid level of the refrigerant held in the condenser 16 and above the liquid level of the refrigerant held in the evaporator 10 in the vertical direction. With this configuration, the electrochemical compressor 11 can easily draw the non-condensable gas thereinto.

Figure 6:
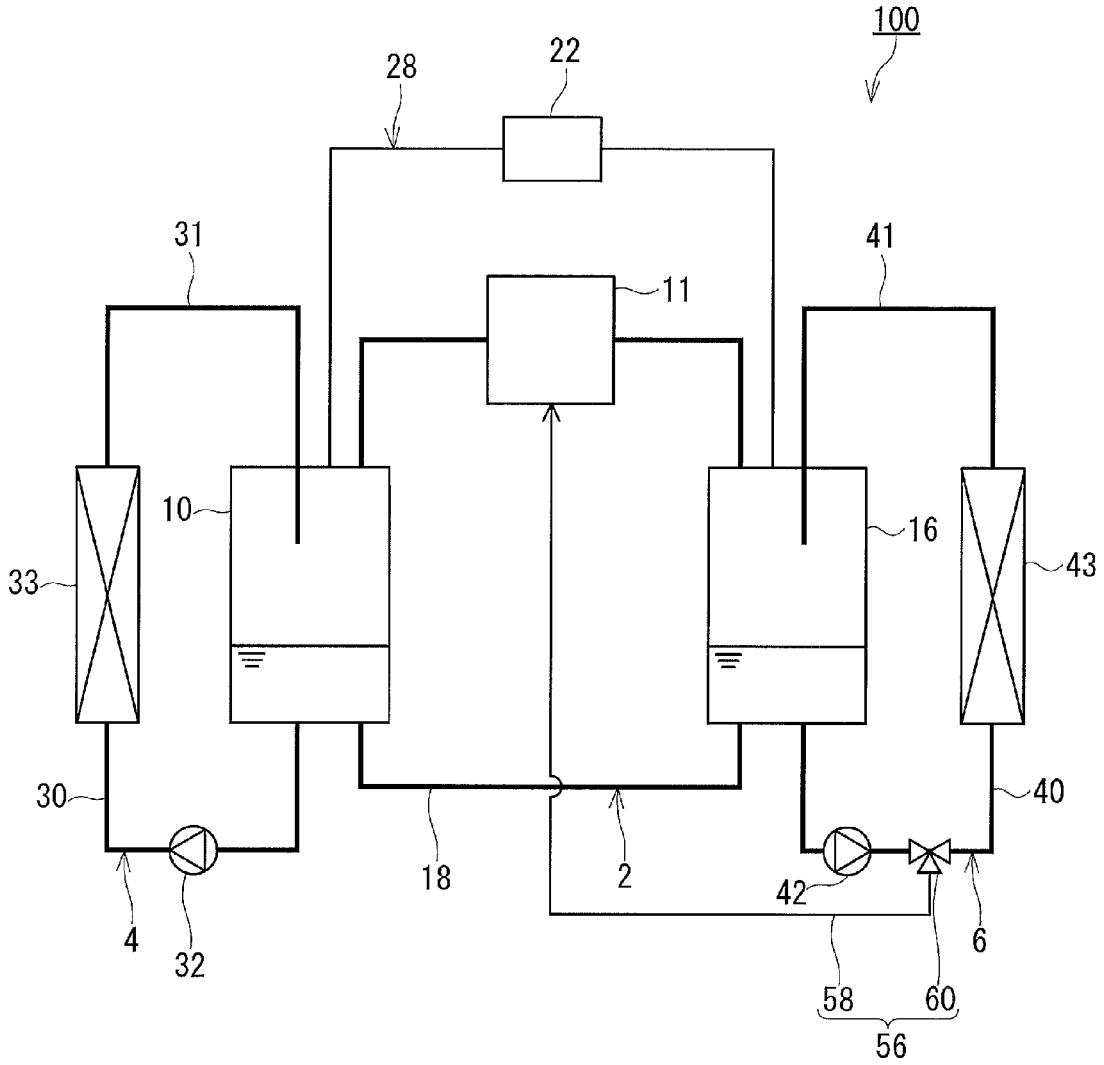
FIG. 6 is a configuration diagram of a heat pump apparatus provided with a startup assist mechanism.

As shown in FIG. 6, the heat pump apparatus 100 may include a startup assist mechanism 56 that wets the electrolyte membrane 13 in the electrochemical compressor 11 with the refrigerant in liquid phase during startup of the heat pump apparatus 100. In the present embodiment, the startup assist mechanism 56 is composed of a refrigerant liquid introduction path 58 and a three-way valve 60. The refrigerant liquid introduction path 58 is a flow path for introducing the refrigerant liquid stored in the condenser 16 into the electrochemical compressor 11. The three-way valve 60 is disposed between the second pump 42 and the second heat exchanger 43 in the flow path 40 of the second circulation path 6. The three-way valve 60 may be replaced by an on-off valve provided in the refrigerant liquid introduction path 58. During the startup of the heat pump apparatus 100, the second pump 42 and the three-way valve 60 are controlled so that the refrigerant liquid is supplied to the electrochemical compressor 11 through the refrigerant liquid introduction path 58. The electrochemical compressor 11 can be started up easily by spraying the refrigerant liquid onto the electrolyte membrane 13 in the electrochemical compressor 11 to wet the electrolyte membrane 13 appropriately.

The refrigerant liquid introduction path 58 may be a flow path for introducing the refrigerant liquid stored in the evaporator 10 into the electrochemical compressor 11. The three-way valve 60 may be disposed between the first pump 32 and the first heat exchanger 33 in the flow path 30 of the first circulation path 4. There is no need to provide an additional pump if the first pump 32 in the first circulation path 4 or the second pump 42 in the second circulation path 6 is used to pump the refrigerant into the refrigerant liquid introduction path 58. The refrigerant liquid introduction path 58 may branch at any position in the heat pump apparatus 100 as long as the refrigerant liquid can be supplied to the electrochemical compressor 11. For example, the refrigerant liquid introduction path 58 may be connected directly to the evaporator 10 or the condenser 16 so that the refrigerant liquid can be obtained directly from the evaporator 10 or the condenser 16. Furthermore, the refrigerant liquid introduction path 58 may branch from the refrigerant delivery path 18.

Next, the operation of the heat pump apparatus 100 will be described.

As shown in FIG. 1, the refrigerant vapor compressed in the electrochemical compressor 11 is condensed in the condenser 16 by exchanging heat with the refrigerant liquid subcooled in the second heat exchanger 43. A portion of the refrigerant liquid condensed in the condenser 16 is delivered to the evaporator 10 through the refrigerant delivery path 18. A portion of the refrigerant liquid stored in the evaporator 10 is supplied to the first heat exchanger 33 by the first pump 32. The refrigerant liquid removes heat from the indoor air in the first heat exchanger 33 and then returns to the evaporator 10. The refrigerant liquid stored in the evaporator 10 boils under reduced pressure and evaporates. The refrigerant vapor generated in the evaporator 10 is drawn into the electrochemical compressor 11. Thus, the indoor space is cooled.

Figure 4:
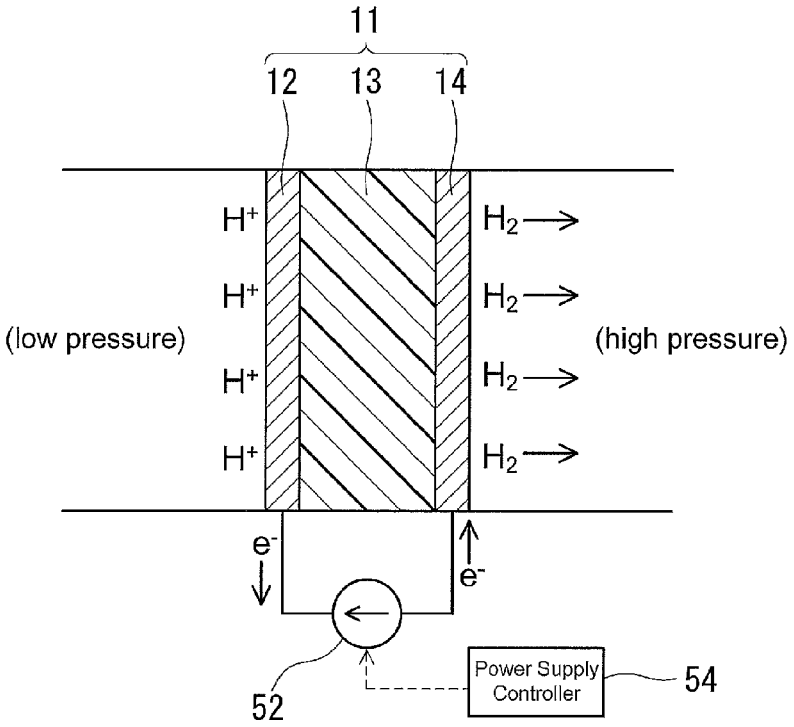
FIG. 4 is a diagram illustrating how an electrochemical compressor operates in the cooling operation.

As shown in FIG. 4, a DC power supply 52 is connected to the first electrode 12 and the second electrode 14 so as to produce an electric field in the direction from the first electrode 12 to the second electrode 14. The potential of the first electrode 12 is, for example, higher by about 0.1 to 1.3 V than that of the second electrode 14 per cell. Hydrogen molecules are split into protons and electrons at the first electrode 12 (anode). The protons migrate across the electrolyte membrane 13, and receive the electrons at the second electrode 14 (cathode). Thus, the protons recombine with the electrons to form hydrogen molecules. In this process, clusters of a polar substance together with the protons move from a space adjacent to the first electrode 12 to a space adjacent to the second electrode 14. As a result, the pressure of the space adjacent to the first electrode 12 decreases, while the pressure of the space adjacent to the second electrode 14 increases.

Figure 5:
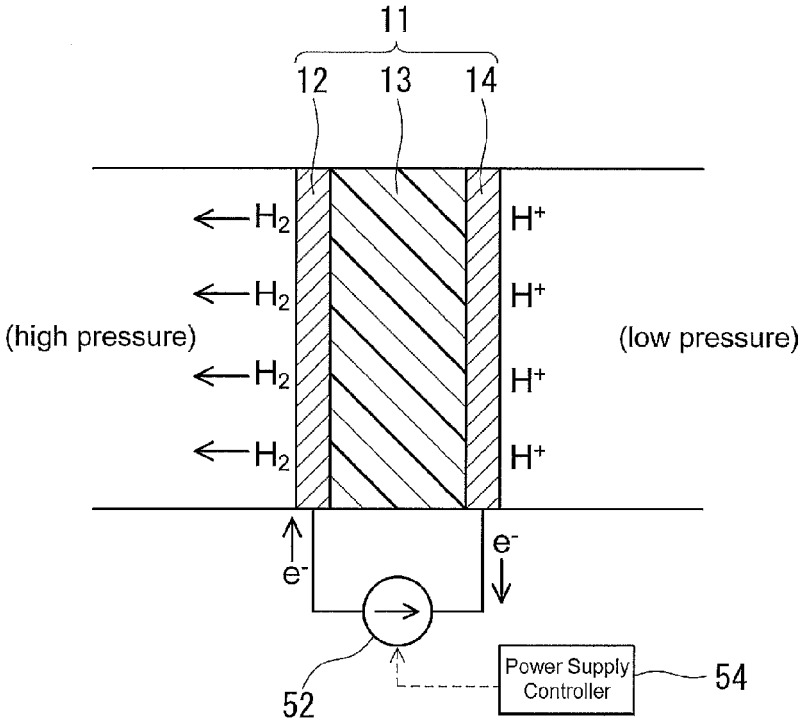
FIG. 5 is a diagram illustrating how the electrochemical compressor operates in the heating operation.

As shown in FIG. 5, when the polarity of the voltage applied to the first electrode 12 and the second electrode 14 is switched so as to produce an electric field in the direction from the second electrode 14 to the first electrode 12, the pressure of the space adjacent to the first electrode 12 increases, while the pressure of the space adjacent to the second electrode 14 decreases. Then, the circulation direction of the refrigerant in the main circuit 2 is reversed, as shown in FIG. 2. Thus, the indoor space is heated.

As shown in FIG. 4 and FIG. 5, the heat pump apparatus 100 includes a power supply controller 54 that switches the polarity of the voltage applied to the electrochemical compressor 11 so as to switch between a first operation mode (FIG. 1 and FIG. 4: cooling operation) and a second operation mode (FIG. 2 and FIG. 5: heating operation). In other words, the power supply controller 54 switches between the first operation mode in which the potential of the first electrode 12 is higher than that of the second electrode 14 and the second operation mode in which the potential of the second electrode 14 is higher than that of the first electrode 12. As shown in FIG. 1, the first operation mode is an operation mode in which the first circulation path 4 serves as a heat absorption circuit and the second circulation path 6 serves as a heat dissipation circuit. Typically, the first operation mode is an operation mode for cooling the indoor space. The second operation mode is an operation mode in which the first circulation path 4 serves as a heat dissipation circuit and the second circulation path 6 serves as a heat absorption circuit. Typically, the second operation mode is an operation mode for heating the indoor space. The use of the power supply controller 54 makes it possible to switch heating operation and cooling operation without using a circuit (four-way valve) for switching the flow direction of the refrigerant.

As shown in FIG. 1, in the first operation mode, the on-off valve 35 in the low-temperature refrigerant introduction path 38 provided on the same side as the second circulation path 6 is opened, and the on-off valve 35 in the low-temperature refrigerant introduction path 38 provided on the same side as the first circulation path 4 is closed. As shown in FIG. 2, in the second operation mode, the on-off valve 35 in the low-temperature refrigerant introduction path 38 provided on the same side as the first circulation path 4 is opened, and the on-off valve 35 in the low-temperature refrigerant introduction path 38 provided on the same side as the second circulation path 6 is closed.

The power supply controller 54 is, for example, a DSP (Digital Signal Processor) including an A/D conversion circuit, an input/output circuit, an arithmetic circuit, a memory device, etc. Like the power supply controller 54, the valve controller 23 shown in FIG. 3 also can be a general-purpose DSP. The power supply controller 54 may share hardware with the valve controller 23. Furthermore, the valve controller 23 and the power supply controller 54 may also share hardware with a controller for controlling the first pump 32, the second pump 42, the on-off valves 35, and the three-way valve 60.

(Modification)

Figure 7:
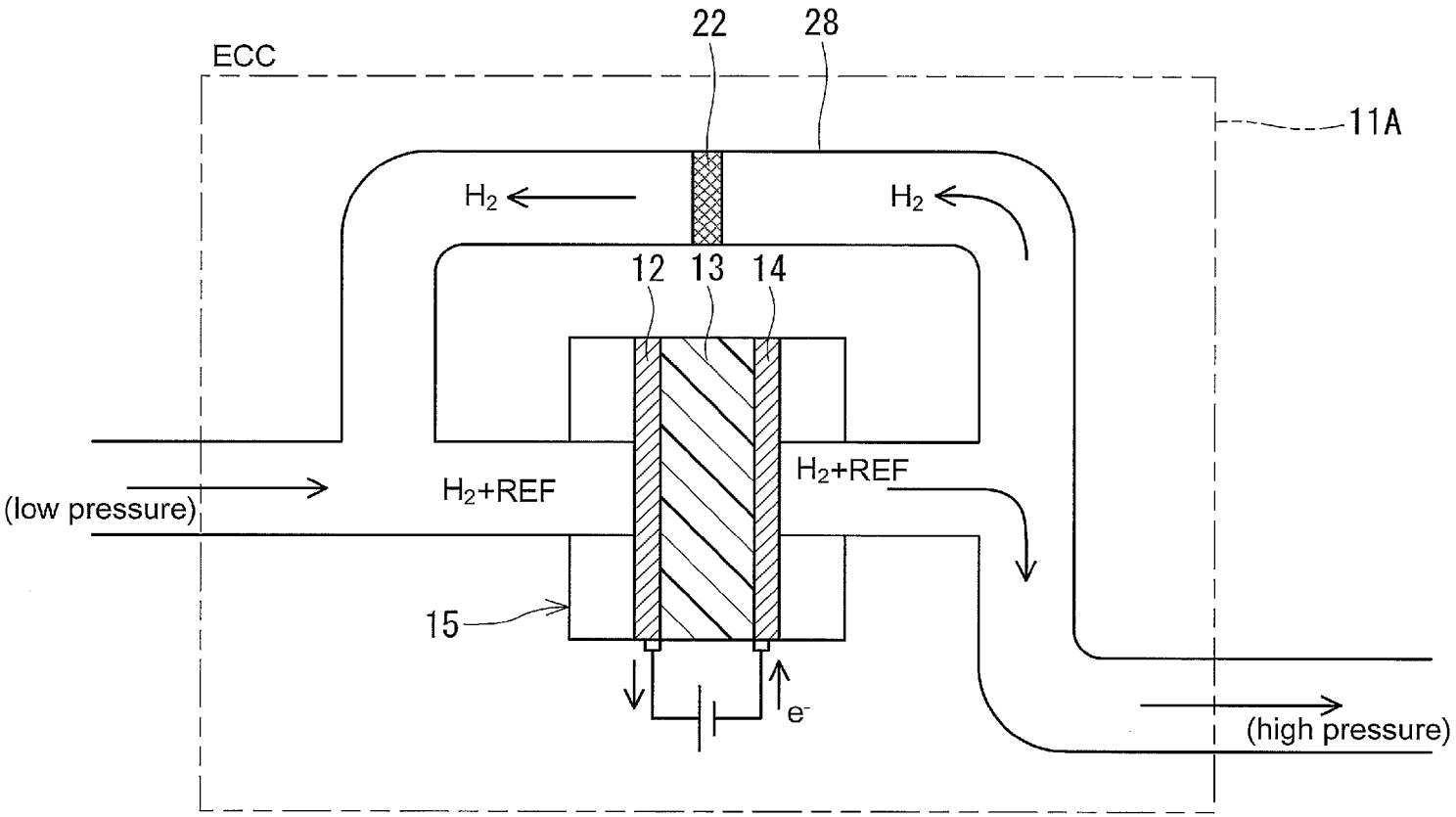
FIG. 7 is a configuration diagram of an electrochemical compressor provided with a non-condensable gas return path provided therein.

An electrochemical compressor 11A shown in FIG. 7 includes a compressor body 15 and a non-condensable gas return path 28. That is, the non-condensable gas return path 28 may be a part of the electrochemical compressor 11A. The non-condensable gas return path 28 is provided with a gate 22. In particular, in the case where the gate 22 is a component that does not require a large space (for example, a hydrogen separation membrane), it is relatively easy to place the non-condensable gas return path 28 in a housing of the electrochemical compressor 11A. As previously described, the compressor body 15 is formed of a membrane-electrode assembly.

INDUSTRIAL APPLICABILITY

The heat pump apparatus disclosed in this description can be widely used in chillers, air conditioners, hot water heaters, etc.

The invention claimed is:

1. A heat pump apparatus comprising:

an evaporator that evaporates a refrigerant;

an electrochemical compressor that compresses the refrigerant evaporated in the evaporator by use of an electrochemically active, non-condensable gas;

a condenser that condenses the refrigerant compressed by the electrochemical compressor;

a refrigerant delivery path for delivering the refrigerant from the condenser to the evaporator; and a non-condensable gas return path provided separately from the refrigerant delivery path, the non-condensable gas return path being configured to communicate a discharge-side high-pressure space of the electrochemical compressor with a suction-side low-pressure space of the electrochemical compressor so as to return the non-condensable gas from the high-pressure space to the low-pressure space.

2. The heat pump apparatus according to claim 1, further comprising a gate provided in the non-condensable gas return path, the gate being capable of maintaining a pressure difference between the high-pressure space and the low-pressure space and being capable of returning the non-condensable gas from the high-pressure space to the low-pressure space.

3. The heat pump apparatus according to claim 2, wherein the gate comprises at least one selected from a capillary, a flow rate regulating valve, and an on-off valve.

4. The heat pump apparatus according to claim 2, wherein the gate comprises an upstream valve disposed on an upstream side in a flow direction of the non-condensable gas and a downstream valve disposed on a downstream side in the flow direction, and the heat pump apparatus further comprises a valve controller that (i) controls the upstream valve and the downstream valve so that the downstream valve is closed and the upstream valve is opened, then (ii) controls the upstream valve and the downstream valve so that the upstream valve is closed while the downstream valve remains closed, and then (iii) controls the upstream valve and the downstream valve so that the downstream valve is opened while the upstream valve remains closed.

5. The heat pump apparatus according to claim 2, wherein the non-condensable gas is hydrogen, and the gate comprises a hydrogen permeable membrane having selective permeability to hydrogen.

6. The heat pump apparatus according to claim 1, wherein the non-condensable gas return path has one end connected to an upper part of the condenser.

7. The heat pump apparatus according to claim 1, further comprising a non-condensable gas trap as a structure that forms a part of the high-pressure space, the non-condensable gas trap being configured to locally increase a concentration of the non-condensable gas, wherein the non-condensable gas return path is connected to the non-condensable gas trap.

8. The heat pump apparatus according to claim 7, wherein the non-condensable gas trap is provided in an upper part of the condenser.

9. The heat pump apparatus according to claim 7, wherein the non-condensable gas trap comprises a partition that surrounds the part of the high-pressure space and a pressure reducing mechanism that reduces a pressure of the space surrounded by the partition.

10. The heat pump apparatus according to claim 9, wherein the pressure reducing mechanism is a low-temperature refrigerant introduction path through which a low-temperature refrigerant obtained by cooling a portion of the refrigerant held in the condenser is introduced into the space surrounded by the partition.

11. The heat pump apparatus according to claim 1, wherein the refrigerant comprises at least one natural refrigerant selected from the group consisting of water, alcohol, and ammonia.

12. The heat pump apparatus according to claim 1, wherein the non-condensable gas is hydrogen.

13. The heat pump apparatus according to claim 1, wherein a positional relationship of the electrochemical compressor, the non-condensable gas return path, the condenser, and the evaporator is determined so that the electrochemical compressor and the non-condensable gas return path are located above a liquid level of the refrigerant held in the condenser and above a liquid level of the refrigerant held in the evaporator in a vertical direction.

14. The heat pump apparatus according to claim 1, further comprising:

a first circulation path which comprises a first pump and a first heat exchanger and through which the refrigerant or another heating medium is circulated between the evaporator and the first heat exchanger by action of the first pump;

a second circulation path which comprises a second pump and a second heat exchanger and through which the refrigerant or another heating medium is circulated between the condenser and the second heat exchanger by action of the second pump; and a power supply controller that switches polarity of a voltage applied to the electrochemical compressor so as to switch between a first operation mode and a second operation mode, the first operation mode being an operation mode in which the first circulation path serves as a heat absorption circuit and the second circulation path serves as a heat dissipation circuit, and the second operation mode being an operation mode in which the first circulation path serves as a heat dissipation circuit and the second circulation path serves as a heat absorption circuit.

15. The heat pump apparatus according to claim 1, further comprising a startup assist mechanism that wets an electrolyte membrane in the electrochemical compressor with the refrigerant in liquid phase during startup of the heat pump apparatus.

16. A heat pump apparatus comprising:

an evaporator that evaporates a refrigerant;

an electrochemical compressor that compresses the refrigerant evaporated in the evaporator by use of an electrochemically active, non-condensable gas, the electrochemical compressor comprising an electrolyte membrane, a molecule-permeable first electrode disposed on a side of a first principal surface of the electrolyte membrane, and a molecule-permeable second electrode disposed on a side of a second principal surface of the electrolyte membrane;

a condenser that condenses the refrigerant compressed by the electrochemical compressor;

a power supply controller that switches between a first operation mode in which a potential of the first electrode is higher than a potential of the second electrode and a second operation mode in which the potential of the second electrode is higher than the potential of the first electrode;

a refrigerant delivery path for delivering the refrigerant from the condenser to the evaporator; and a non-condensable gas return path provided separately from the refrigerant delivery path, the non-condensable gas return path being configured to communicate a discharge-side high-pressure space of the electrochemical compressor with a suction-side low-pressure space of the electrochemical compressor so as to return the non-condensable gas from the high-pressure space to the low-pressure space.

* * * * *